US006203084B1

(12) United States Patent
Kruk et al.

(10) Patent No.: US 6,203,084 B1
(45) Date of Patent: Mar. 20, 2001

(54) GRIPPER ARM ASSEMBLY

(75) Inventors: Robert R. Kruk, McHenry; Robert R. Kruk, Jr., Crestwood; James Ortiz, Villa Park; James Raftery, Monee, all of IL (US)

(73) Assignee: Inscerco Mfg., Inc., Crestwood, IL (US)

( * ) Notice: Subject to any disclaimer, the term of this patent is extended or adjusted under 35 U.S.C. 154(b) by 0 days.

(21) Appl. No.: 09/244,643

(22) Filed: Feb. 4, 1999

(51) Int. Cl.[7] ..... B65H 5/10; B65H 43/02; B21J 15/02

(52) U.S. Cl. ..... 294/104; 294/88; 294/907

(58) Field of Search ..... 294/104, 907, 294/50.9, 88, 117; 901/46

(56) References Cited

U.S. PATENT DOCUMENTS

| | | | | |
|---|---|---|---|---|
| 1,049,492 | | 1/1913 | Juengst . | |
| 1,109,127 | | 9/1914 | Juengst . | |
| 2,325,455 | * | 1/1943 | Williams | 53/57 |
| 2,949,293 | | 8/1960 | Fields et al. | 270/56 |
| 3,202,095 | | 8/1965 | Sather et al. | 101/233 |
| 3,260,517 | | 7/1966 | Sather | 270/58 |
| 3,262,696 | | 7/1966 | Zuercher | 270/58 |
| 3,271,022 | | 9/1966 | Sather et al. | 270/58 |
| 3,744,787 | | 7/1973 | Morrison | 270/56 |
| 3,871,639 | | 3/1975 | Felix | 270/52 |
| 3,885,780 | * | 5/1975 | Morrison | 270/56 |
| 3,891,204 | | 6/1975 | Mager | 271/85 |
| 4,013,283 | | 3/1977 | Tress et al. | 271/14 |
| 4,039,180 | * | 8/1977 | Stocker | 271/10.04 |
| 4,066,969 | | 1/1978 | Pearce et al. | 328/5 |
| 4,173,427 | | 11/1979 | Beuch et al. | 414/751 |
| 4,243,216 | | 1/1981 | Mazumder | 271/263 |
| 4,258,326 | | 3/1981 | Johne | 328/5 |
| 4,284,301 | | 8/1981 | Geiger et al. | 294/104 |
| 4,344,729 | | 8/1982 | Orsinger et al. | 414/226 |
| 4,426,785 | | 1/1984 | Loftus et al. | 33/147 L |
| 4,428,041 | | 1/1984 | Honkawa | 364/183 |
| 4,448,056 | | 5/1984 | Baba | 72/422 |
| 4,462,585 | | 7/1984 | Gieson et al. | 271/11 |
| 4,511,130 | | 4/1985 | Barton et al. | 270/54 |
| 4,634,107 | * | 1/1987 | Vandersyde et al. | 271/56 |
| 4,697,246 | * | 9/1987 | Zemke | 702/128 |
| 4,728,097 | | 3/1988 | Vandersyde et al. | 271/268 |
| 4,798,040 | * | 1/1989 | Hass et al. | 53/460 |
| 5,000,434 | * | 3/1991 | Vandersyde et al. | 270/58.06 |
| 5,033,785 | | 7/1991 | Woolley, Jr. | 294/104 |
| 5,390,908 | | 2/1995 | Luxem | 271/247 |
| 5,647,583 | * | 7/1997 | Emigh et al. | 270/52.04 |
| 5,704,246 | * | 1/1998 | Kruger | 73/159 |
| 5,816,771 | | 10/1998 | Stevens | 414/729 |
| 5,823,521 | * | 10/1998 | Emigh et al. | 270/58.06 |

* cited by examiner

*Primary Examiner*—Dean J. Kramer
*Assistant Examiner*—Paul T. Chin
(74) *Attorney, Agent, or Firm*—Olson & Hierl, Ltd.

(57) ABSTRACT

An arm assembly for gripping a sheet of material including jaws and a sensor assembly for detecting a change in the thickness of the material gripped between the jaws. A sensor is mounted to the side of the arm and a lever is operatively associated with the jaws for pivotal movement towards and away from the sensor in response to a change in the thickness of the material gripped between the jaws. In one embodiment, a magnet is mounted to the tip of the lever and the sensor is a Hall-effect sensor which is responsive to a change in the distance between the sensor and the magnet.

16 Claims, 3 Drawing Sheets

22
10
12
16
18
54
52
56
60
48
58
50
44
46
106
104
120
118
122
90
94
96
100
102
84
98
92
116
86
114
112
108
95
34
28
32
30
110
42
26
36
82
76
78
80
74
72
14
33
50
46
44
96
92
86
116
114
98
112
108
76
110
42
26
30
28
32

GRIPPER ARM ASSEMBLY

FIELD OF THE INVENTION

This invention relates to a gripper arm assembly in an apparatus for inserting sheets of material into envelopes and, more particularly, to a sensor assembly on the arm assembly for detecting a change in the thickness of the material gripped between the jaws of the arm assembly.

BACKGROUND OF THE INVENTION

Apparatus for inserting sheets of material into envelopes are well known in the art: see, for example, U.S. Pat. No. 2,325,455 which discloses a "Phillipsburg" type envelope handling machine incorporating a plurality of spaced apart reciprocable gripper arm assemblies including jaw members which are each selectively operable to grip and retrieve a sheet of material from a pick-up station for later insertion into an envelope.

In most situations, it is desirable for the jaws on each of the gripper arms to grip and retrieve one sheet of material. However, in some instances, the jaws mistakenly fail to grip even the one required sheet of material and, in other instances, the jaws mistakenly grip more than one sheet of material. These conditions are typically referred to as "miss" and "double" fault conditions respectively.

A number of different detection structures have been used to detect these fault conditions. One such detection structure is shown in U.S. Pat. No. 3,885,780 which discloses a gripper arm including a lever which is attached to a movable jaw and is pivotable in one direction into contact with one switch or electrode to detect a "miss" fault condition and in the opposite direction into contact with an opposed switch or electrode to detect a "double" fault condition.

A disadvantage associated with this sensor structure is that the switch contact points on each of the arms must be manually adjusted at the beginning of every job depending upon the thickness of the insert sheets of material. The switch contact points, being high tolerance electrical components, also have a tendency over time to wear and become oxidized and highly resistive thus contributing to the inaccurate detection of fault conditions.

In an effort to overcome the problems associated with detector structures incorporating such high tolerance electrical components, gripper arms have also incorporated sensor structures such as those disclosed in, for example, U.S. Pat. Nos. 4,634,107; 5,647,583; and 5,704,246.

U.S. Pat. No. 4,634,107 discloses a gripper arm incorporating a Hall-effect sensor located adjacent the distal end of the gripper arm which cooperates with a disc-shaped magnet which is mounted to the side of the movable jaw and is positioned directly opposite the sensor. In operation, the displacement of the movable jaw in response to a "miss" or "double" fault situation causes the magnet to slide across the sensor. The "miss" or "double" fault condition is detected by measuring the change in the sensor's voltage output resulting from a change in the intensity of the magnetic flux lines in response to a change in the location of the magnet in relation to the sensor.

U.S. Pat. No. 5,647,583 discloses a gripper arm incorporating a Hall-effect sensor which is placed in the lower stationary jaw of the arm. A disc-shaped magnet is positioned immediately below the sensor. As the movable jaw is moved closer or further from the sensor in response to a "miss" or "double" fault condition, the magnetic flux lines created by the magnet are correspondingly intensified or detensified and the sensor produces a voltage output which is proportional in magnitude to the distance between the movable jaw and the sensor. The voltage outputs are fed to a computer which determines the presence of either a "miss" or "double" fault condition.

U.S. Pat. No. 5,704,246 discloses a gripper arm incorporating a lever which is operatively associated for pivotal movement in response to the displacement of the movable jaw. The lever includes an arcuate raster gauge at the distal end thereof including spaced apart raster detection marks. A pair of sensors which are secured to the side of the gripper arm opposite the raster gauge are adapted to detect a change in the location of the raster gauge marks in response to the pivotal movement of the lever in response to either a "miss" or "double" fault condition.

A disadvantage associated with the Hall-effect sensor structures disclosed in U.S. Pat. Nos. 4,697,246 and 5,647,583 is the placement and location of the magnet generally adjacent to the associated movable jaw. In applications where relatively thin sheets of material are gripped by the jaws, a "miss" or "double" fault condition results in the negligible or minute displacement of the movable jaw which, because of the generally adjacent relationship between the jaw and the magnet, results in a corresponding negligible or minute change in the intensity of the magnetic flux lines which is not always detectable by the sensor.

Moreover, in U.S. Pat. No. 5,647,583, the presence of the one or more sheets of material between the magnet and the movable jaw creates a barrier between the sensor and the jaw which reduces the magnet's ability to accurately detect a change in the position of the movable jaw.

A disadvantage of the sensor structure disclosed in U.S. Pat. No. 5,704,246 is that it requires the use of a specially manufactured arcuate raster gauge.

What is needed is a gripper arm incorporating an improved sensor and cooperating magnet assembly which provides for a high degree of detection in all applications including those applications where relatively thin sheets of materials are gripped between the jaws of the arm.

SUMMARY OF THE INVENTION

The present invention provides an arm assembly for gripping a sheet of material from a station which has an arm including one end adapted to be secured to a drive shaft and an opposite end including a first jaw and a second opposed jaw mounted to the arm for movement relative to the first jaw. A drive assembly is operably associated with the movable jaw for moving the movable jaw between an open position and a closed position where the sheet of material is gripped between the jaws.

The arm assembly also includes a sensor assembly for detecting a change in the thickness of the material gripped between the jaws in response to either a "miss" fault condition where the jaws mistakenly fail to grip a sheet of material from the pick-up station or a "double" fault condition where the jaws mistakenly grip two or more sheets of material from the pick-up station. The sensor assembly includes a sensor mounted to the side of the arm and a lever operatively associated with the movable jaw and the sensor for pivotal movement towards and away from the sensor in response to a change in the thickness of the material gripped between the jaws. In accordance with the present invention, the sensor is responsive to a change in the distance between the sensor and the lever for detecting a change in the thickness of the material between the jaws.

In one embodiment, the movable jaw and the lever are mounted to a pivot pin and the lever extends generally upwardly from the pivot pin. The lever includes a distal end with a generally inwardly extending finger including a tip. A magnet is secured to the tip of the finger and the sensor is a Hall-effect sensor responsive to a change in the distance between the sensor and the magnet.

In one embodiment, the sensor assembly includes a generally L-shaped sensor mounting bracket including a first plate mounted to the side of the arm and a second unitary plate extending generally normally outwardly from the side of the arm. In this embodiment, the sensor is mounted to the inside face of the second plate and the lever and the magnet thereon are positioned generally opposite the second plate.

The relationship and orientation of the lever relative to the movable jaw is particularly advantageous in applications where relatively thin sheets of material are gripped between the jaws and the presence of a "miss" or "double" fault condition results in a negligible change in the displacement of the movable jaw. In these applications, the angular relationship between the movable jaw and the lever coupled with the length of the lever advantageously amplifies the negligible displacement of the movable jaw into an appreciable angular displacement of the magnet on the lever which can be more accurately and consistently detected by the sensor.

Additionally, the positioning of the sensor and magnet remote from the jaws and any other components eliminates any barriers which might effect or distort the intensity of the magnetic flux lines created by the magnet.

Other and further objects, aims, features, advantages, purposes, arrangements, embodiments, and the like will be apparent to those skilled in the art from the following description together with the accompanying drawings and appended claims.

DETAILED DESCRIPTION OF THE PREFERRED EMBODIMENT

Figures 1, 2:
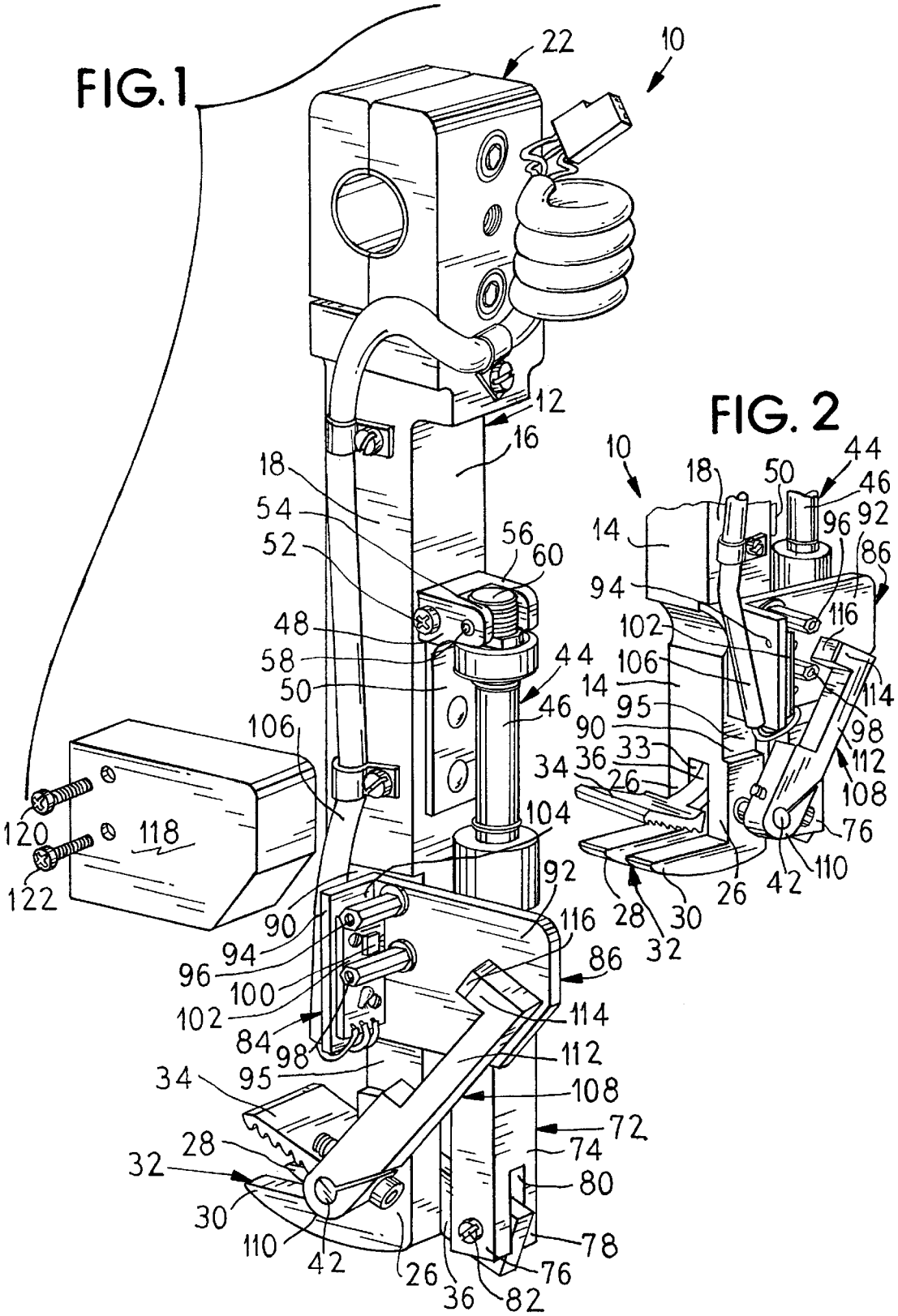
FIG. 1 is a perspective view of a gripper arm in accordance with the present invention.
FIG. 2. is a broken alternate perspective view of the jaws of the gripper arm of FIG. 1.

Referring to the drawings, FIGS. 1–4 depict a gripper arm assembly 10 constructed in accordance with the present invention. Although not shown or described herein, it is understood that the gripper arm assembly 10 is adapted for use in, for example, a "Phillipsburg" type inserting machine of the type disclosed and described generally in U.S. Pat. No. 2,325,455 which includes a plurality of spaced apart gripper arms each adapted to grip, retrieve and subsequently insert sheets of material into envelopes.

The gripper arm assembly 10 is preferably made of metal and includes an elongate arm 12 having opposed front and back faces 14 and 16 respectively and opposed side faces 18 and 20 respectively. The arm 12 includes a proximal end including a removable clamp 22 which mounts the gripper arm 12 to a drive shaft (not shown) which allows for the pivotal back and forth movement of the arm 12 towards and away from the sheet pick-up station on the inserter machine.

The distal end of the arm 12 opposite the clamp 22 includes a fork 26 including two spaced apart unitary generally L-shaped members 28 and 30 defining a distal generally horizontal jaw 32.

A movable jaw 34 is positioned generally opposite and above the jaw 32. Jaw 34 includes a unitary arm 36 extending rearwardly into and through an opening 33 (FIG. 2) defined between the spaced members 28 and 30 of the fork 26. Arm 36 further includes a pair of generally cylindrical spaced apart apertures (not shown). One of the apertures in the arm 36 is aligned with apertures (not shown) in the fork members 28 and 30 respectively for receiving a rotatable pivot pin 42 which secures the jaw 34 for pivotal movement as the arm 12 in relation to the jaw 32 between the open position shown in FIGS. 1 and 2 and the closed gripping position shown in FIG. 5.

The pivotal movement of jaw 34 is provided by a drive assembly 44 which, in the present embodiment of the present invention, comprises a pneumatic assembly including an air cylinder 46 mounted to, and hanging generally downwardly from, a bracket 48 mounted to the back face 16 of the arm 12. Bracket 48 is generally L-shaped and includes a longitudinally extending plate 50 secured to the back face 16 of the arm 12. A hinge 52 is pivotally connected to, and extends generally normally outwardly from, the plate 50. Hinge 52 includes two spaced apart fingers 54 and 56 with aligned apertures (not shown) for receiving a pin 58.

Figure 4:
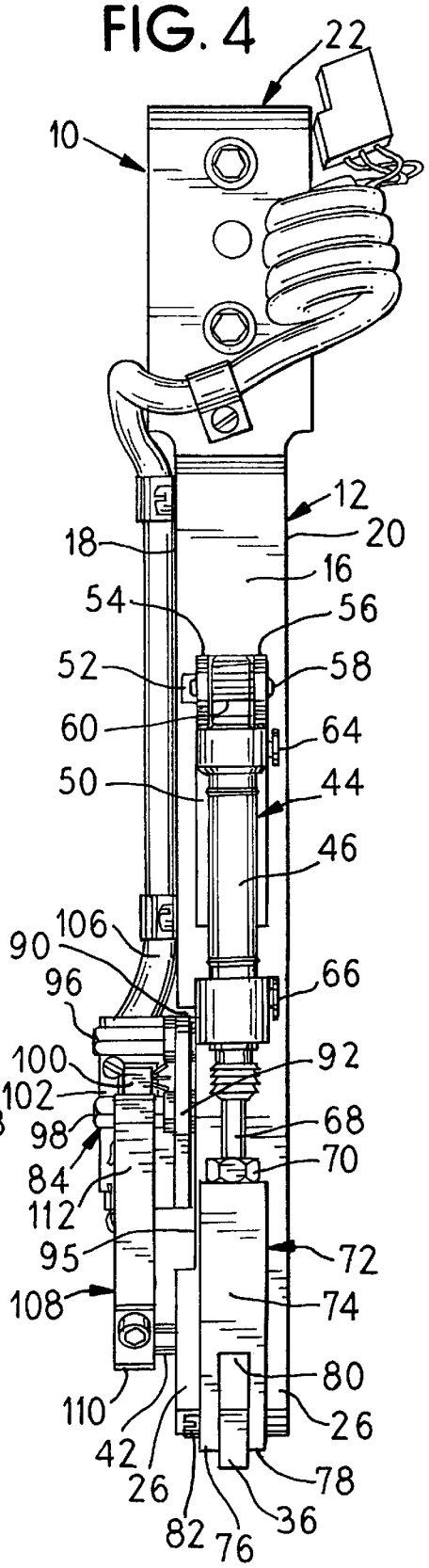
FIG. 4 is a rear elevational view of the gripper arm of FIG. 1.

Pneumatic cylinder 46 includes a top hub 60 with a pin receiving aperture (not shown). Cylinder 46 additionally includes respective pressurized air inlet and outlet ports 64 and 66 (FIG. 4). The hub 58 is fitted between the fingers 54 and 56 and the pin 58 extends through the aligned hub and finger apertures to secure the cylinder 46 in a spaced and hanging relationship relative to the arm 12.

A reciprocable shaft 68 (FIG. 4) extends from the distal end of the cylinder 46. A nut 70 and a coupling 72 are threaded to the end of the shaft 68. Coupling 72 includes a body 74 and two spaced apart distal fork members 76 and 78 defining an opening 80 therebetween adapted to receive the end of the arm 36 of the movable jaw 34. A pin 82 extends through aligned apertures (not shown) in the fork members 76 and 78 and the second aperture (not shown) in the arm 36 for securing the coupling 72, and thus the drive assembly 44, to the movable jaw 34.

The shaft 68 is operably associated in response to the activation of the pneumatic cylinder 46 for reciprocal movement between an extended position (FIGS. 1 and 4) to open the movable jaw 34 and a retracted position (FIG. 5) where the movable jaw 34 is closed and a sheet of material 62 is gripped between the jaws 32 and 34. Nut 70 is rotatable clockwise or counterclockwise to adjust the combined length of the shaft 68 and coupling 72 which, in turn, adjusts the size of the opening between jaws 32 and 34.

Figure 6:
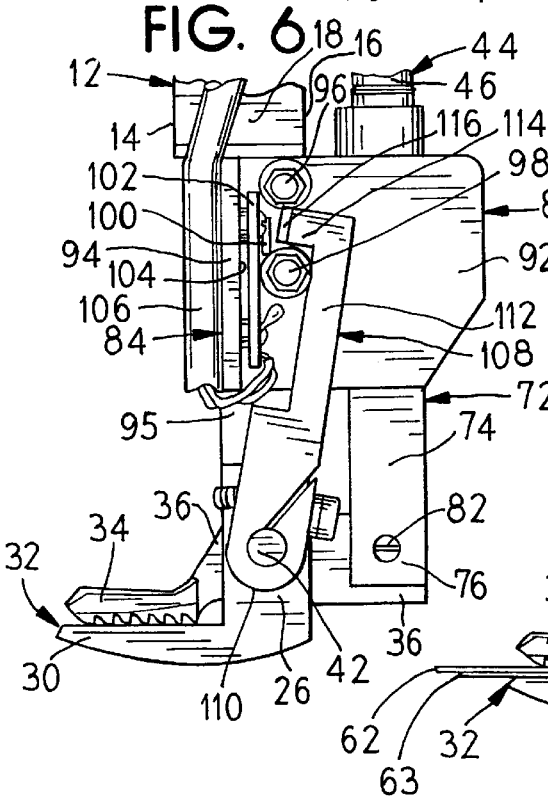
FIG. 6 is a broken side elevational view depicting the relationship and placement of the jaws and associated sensor assembly in the "miss" fault condition where the jaws are closed without a sheet of material gripped therebetween.
Figure 7:
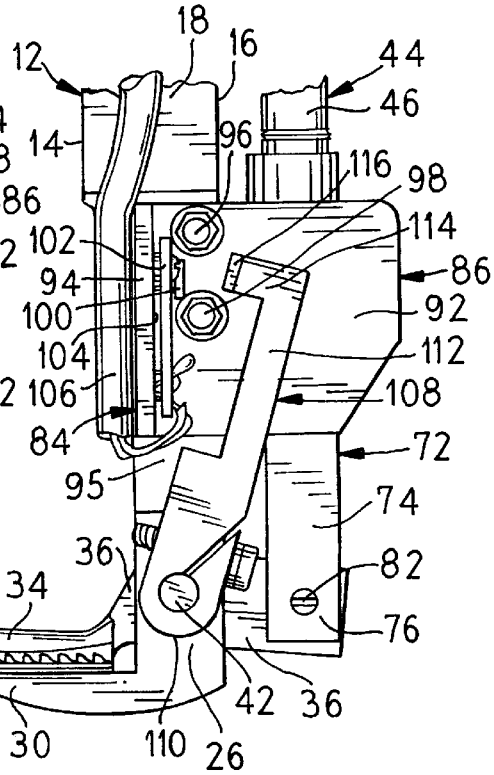
FIG. 7 is a broken side elevational view depicting the relationship and placement of the jaws and associated sensor assembly in the "double" fault condition where two or more sheets of materials are gripped between the jaws.

A common problem associated with the use and operation of a "Phillipsburg" type inserter machine is the gripper arm's failure to grip and retrieve a single sheet of material as shown in FIG. 6 and further the gripper arm's gripping and retrieval of two or more sheets of material 62 and 63 as shown in FIG. 7. These two "fault" conditions are known and referred to in the industry as "miss" and "double" fault conditions respectively.

The gripper arm assembly 10 of the present invention incorporates an improved sensor assembly 84 for accurately and consistently detecting both of these fault conditions. Particularly, and as shown in FIGS. 1–4, the sensor assembly 84 includes a generally L-shaped sensor mounting bracket 86 seated in a rectangularly shaped cavity 90 (FIG. 4) which is located generally adjacent to and above the distal fork 26 and extends into the side face 18 of the arm 12.

Bracket 86 includes a flat base plate 92 and a unitary flat side plate 94 extending generally normally outwardly from one of the side edges of the base plate 92. Bracket 86 is mounted to the arm 12 in an orientation where base plate 92 is seated against the outer surface 95 (FIG. 4) of the cavity 90 and the side plate 94 is aligned generally co-planarly with the front face 14 of the arm 12 and extends generally normally outwardly from the side face 18 of the arm 12. Bracket 86 is secured to the side of the arm 12 by means of a pair of screws 96 and 98 which extend through the base plate 92 and into the outer surface 95 of the cavity 90.

Sensor assembly 84 further includes a sensor 100 which, in the embodiment shown, is a Hall-effect sensor having the recognized characteristic of producing an output voltage proportional to the intensity of a magnetic field perpendicular to it. The sensor 100 and its associated circuitry components are mounted on a sensor board 102 mounted to the interior face 104 of the side plate 94 in an orientation generally normal to the base plate 92 and the side face of arm 12. A sensor line 106 extends between the sensor 100 and a computer (not shown).

Figure 3:
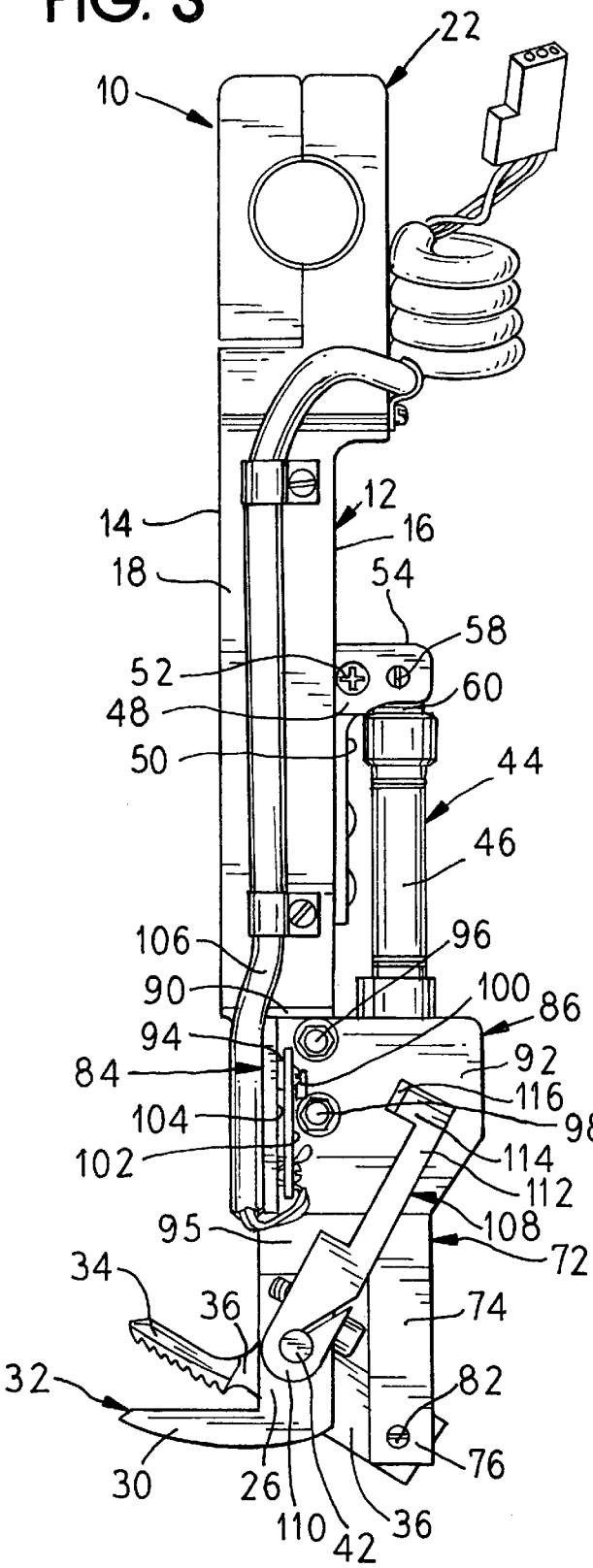
FIG. 3 is a side elevational view of the gripper arm of FIG. 1.

Sensor assembly 84 additionally includes an elongate magnet lever 108 which is operatively associated with the sensor 100 for detecting both "miss" and "double" fault conditions. Particularly, and as shown in FIG. 3, the lever 108 includes a base 110 secured to the end of pivot pin 42, a unitary generally rectangularly shaped arm 112 extending generally upwardly from the base 110 and the pin 42, and a bent generally rectangularly shaped sensing finger 114 extending generally normally inwardly from the end of the arm 112. A generally square shaped magnet 116 is mounted to the tip of the inwardly bent finger 114. In accordance with the present invention, the included angle between the lever 108 and the jaw 34 is greater than 90 degrees.

A sensor bracket cover 118 (FIG. 1), which in the embodiment shown is made of plastic, is adapted to be fitted over the sensor bracket 86 and the finger 114 of lever 108 to protect the sensor 100 and the magnet 116 from dust and the like particles during operation of the inserter machine. The cover 118 is secured to the bracket 86 by a pair of screws 120 and 122 which extend through the cover 118 and into the top threaded portions of screws 96 and 98 respectively on the bracket 86.

As shown in FIGS. 1 and 4, lever 108 is positioned relative to the sensor bracket 86 and the sensor 100 in an orientation where arm 112 is positioned in a generally spaced apart and parallel relationship to the base plate 92 and the finger 114 is positioned generally opposite and in spaced relation to the sensor 100.

Figure 5:
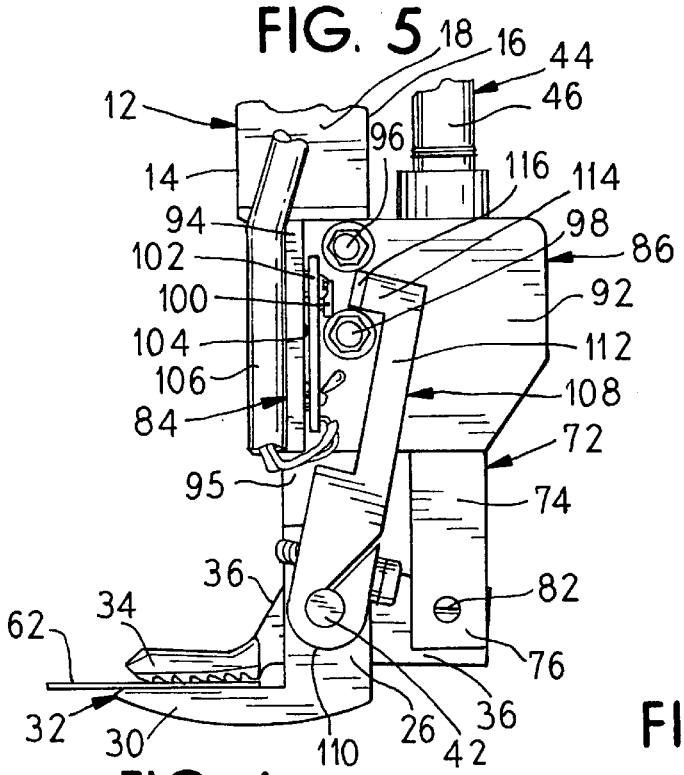
FIG. 5 is a broken side elevational view depicting the relationship and placement of the jaws and associated sensor assembly where a single sheet of material is gripped between the jaws.

In accordance with the present invention, the lever 108 and, more particularly, the finger 114 thereon are pivotable from the neutral position of FIG. 5 to the position of FIG. 6 where the finger 114 is rotated counterclockwise towards and into close proximity with the sensor 100 in response to a "miss" fault condition where the jaws 32 and 34 have mistakenly failed to grip a sheet of material. Alternatively, the lever 108 and the finger 114 are pivotable from the neutral position of FIG. 5 to the position of FIG. 7 where the finger 114 is rotated clockwise in a direction away from the sensor 100 in response to a "double" fault condition where the jaws 32 and 34 have mistakenly gripped two sheets of material.

The detection of the "miss" fault condition on the one hand is accomplished as a result of the sensor's production of one particular output voltage in response to an increase in the intensity of the magnetic flux lines created by the magnet 116 when the lever 108 is rotated counterclockwise towards the sensor 100 as shown in FIG. 6. The detection of the "double" fault condition, on the other hand, is accomplished as a result of the sensor's production of a proportional second output voltage in response to a decrease in the intensity of the magnetic flux lines created by the magnet 116 when the lever 108 is rotated clockwise away from the sensor 100 as shown in FIG. 7.

Although not shown or described herein, it is understood that the output voltages produced by the sensor 100 are fed via the sensor line 106 to a computer (not shown) which is programmed to recognize and read the respective output voltages and subsequently convert such readings into appropriate machine interrupt commands. It is also understood that the present invention encompasses other equivalent sensor structures which do not incorporate a magnet such as, for example, those operative on inductive, capacitive, or optical principles to sense a change in the distance between the sensor and the lever.

The relationship and orientation of the lever 108 relative to the movable jaw 34 is particularly advantageous in applications where relatively thin sheets of material are gripped between the jaws 32 and 34 and the presence of a "miss" or "double" fault condition results in a negligible change in the displacement of the movable jaw 34. In these applications, the obtuse angular relationship between the movable jaw 34 and the lever 108 coupled with the length of the lever 108 and the remote positioning of the magnet 116 advantageously amplifies the negligible displacement of the jaw 34 into an appreciable angular displacement of the magnet 116 which can be more accurately and consistently detected by the sensor 100.

The sensor structure of the present invention is also advantageous in that it incorporates the use of a stock and standard magnet 116 thus eliminating the risk of "dead" spots which sometimes result during the cutting of custom shaped magnets such, as for example, the disc-shaped magnet disclosed in U.S. Pat. No. 5,647,583. The positioning of the sensor and magnet remote from the jaws and any other components also eliminates any barriers which might affect or distort the intensity of the magnetic flux lines created by the magnet.

Various modifications, alterations, changes and improvements to the invention disclosed and described herein may be made without departing from the spirit and scope thereof.

What is claimed is:

1. An arm assembly for gripping a sheet of material from a station comprising:

an arm including one end adapted for securement to a drive shaft and an opposite end including a first jaw and a second opposed jaw mounted to said arm for movement relative to said first jaw;

a drive assembly operably associated with said second jaw for moving said second jaw between an open position and a closed position where the sheet of material is gripped between said first and second jaws;

a sensor assembly for detecting a change in the thickness of the material gripped between said jaws including:

a sensor mounted to the side of said arm; and an elongate lever including a proximal end operatively associated with said second jaw and a distal end operatively associated with said sensor for pivotal movement towards and away from said sensor in response to a change in the thickness of the material gripped by said jaws, said sensor being continuously responsive to change in the distance between said sensor and said distal end of said lever for detecting change in the thickness of the material between said jaws.

2. The arm assembly of claim 1 wherein said distal end includes a magnet, said sensor being a Hall-effect sensor responsive to change in the distance between said sensor and said magnet.

3. The arm assembly of claim 2 wherein said lever includes a generally inwardly extending finger including a tip, said magnet being secured to said tip of said finger.

4. The arm assembly of claim 1 wherein said second jaw and said lever are mounted to a pivot pin extending through said arm, said lever extending from said pivot pin at an obtuse angle and including a finger extending generally inwardly from the end thereof and a magnet secured to the end of said finger, said finger being positioned generally opposite said sensor and said sensor being responsive to change in the distance between said sensor and said magnet.

5. The arm assembly of claim 1 wherein said sensor is mounted on a bracket mounted to the side of said arm.

6. The arm assembly of claim 1 wherein said sensor assembly further includes a bracket extending generally normally outwardly from the side of said arm, said sensor being mounted to the inside face of said bracket, said lever being positioned generally opposite said bracket and said sensor.

7. The arm assembly of claim 1 wherein said sensor assembly includes a generally L-shaped bracket including a first plate mounted to the side of said arm and a second unitary plate extending generally normally outwardly from the side of said arm, said sensor being mounted to the inside face of said second plate, said lever being positioned generally opposite said second plate and said sensor.

8. The arm assembly of claim 1 wherein said second jaw and said lever are mounted to a pivot pin extending through said arm and said lever extends upwardly from said pivot pin at an obtuse angle relative to said second jaw.

9. A gripper arm assembly for gripping and retrieving a sheet of material from a station comprising:

an arm including opposed ends, one of the ends being adapted for securement to a drive shaft and the other end including first and second opposed jaws, said second jaw being mounted on a pivot pin for pivotable movement relative to said first jaw;

a drive assembly operably associated with said second jaw for pivoting said second jaw between an open position and a closed position where the sheet of material is gripped between said first and second jaws;

a sensor mounted on a generally L-shaped bracket including a first plate mounted to the side of said arm and a second unitary plate extending generally normally outwardly from the side of said arm, said sensor being mounted to the inside face of said second plate;

a lever including one end secured to said pivot pin and an opposite end including a magnet, said lever and said magnet being positioned generally opposite said second plate of said bracket and said sensor, and being pivotable towards and away from said sensor in response to the movement of said second jaw, said sensor being responsive to change in the distance between said sensor and said magnet on said lever for detecting change in the thickness of the material between said first and second jaws.

10. The gripper arm assembly of claim 9 wherein said lever includes a distal finger bent inwardly in the direction of said sensor and said magnet is secured to the end of said finger.

11. The gripper arm assembly of claim 9 wherein said lever extends generally upwardly from said pivot pin at an obtuse angle and includes a base mounted to said pivot pin, a unitary arm extending from said base and a unitary finger extending generally normally inwardly from the end of said arm, said magnet being secured to the end of said finger.

12. The gripper arm assembly of claim 9 wherein said sensor is a Hall-effect sensor.

13. A gripper arm assembly for gripping and retrieving a sheet of material from a station comprising:

an elongate arm including a first end adapted for securement to a drive shaft and a second end including first and second opposed jaws, said second jaw being mounted to a pin for pivotable movement relative to said first jaw;

a drive assembly for pivoting said second jaw between open and closed positions;

a generally L-shaped bracket including a first plate mounted to the side of said arm and a second unitary plate extending generally normally outwardly from the side of said arm;

a sensor mounted to the inside face of said second plate of said bracket;

a lever positioned generally opposite and in spaced relation to said sensor, said lever including one end secured to said pin and being pivotable towards and away from said sensor in response to the movement of said second jaw, said lever further including a finger at the other end turned inwardly in the direction of said sensor, said finger including a magnet whereby said sensor is responsive to change in the distance between said sensor and said magnet on said finger for detecting change in the thickness of the material between said first and second jaws.

14. The gripper arm assembly of claim 13 wherein said lever includes an arm extending from said pin at an obtuse angle, said finger extending generally normally inwardly from the end of said arm.

15. The gripper arm assembly of claim 13 wherein said sensor is a Hall-effect sensor.

16. The gripper arm assembly of claim 13 wherein said drive assembly includes a pneumatic cylinder hanging from a bracket mounted to said arm, and a reciprocable shaft extending between said cylinder and said second jaw.

* * * * *